United States Patent [19]

Carter

[11] 4,345,534

[45] Aug. 24, 1982

[54] SAIL RIGGING SYSTEM

[75] Inventor: Richard E. Carter, Nahant, Mass.

[73] Assignee: Carter Offshore Design, Inc., Nahant, Mass.

[21] Appl. No.: 84,546

[22] Filed: Oct. 15, 1979

[51] Int. Cl.[3] ..... B63H 9/04

[52] U.S. Cl. ..... 114/106; 114/39

[58] Field of Search ..... 114/39, 102, 103, 104, 114/105–109; 9/310 E

[56] References Cited

U.S. PATENT DOCUMENTS

| | | | |
|---|---|---|---|
| 1,613,890 | 1/1927 | Herpeshoff | 114/39 |
| 3,938,460 | 2/1976 | Wales et al. | 114/106 |
| 4,061,099 | 12/1977 | Cook | 114/102 |
| 4,100,870 | 7/1978 | Prade | 114/39 |

FOREIGN PATENT DOCUMENTS

| | | | |
|---|---|---|---|
| 540883 | 4/1922 | France | 114/39 |
| 739692 | 11/1955 | United Kingdom | 114/102 |

OTHER PUBLICATIONS

Ross, *Sailpower*, 101–104, (Alfred A. Kopf Inc., 1975 Ed.).

*Primary Examiner*—Trygve M. Blix
*Assistant Examiner*—Jesús D. Sotelo
*Attorney, Agent, or Firm*—David G. Conlin

[57] ABSTRACT

A sailing rig for driving a vessel which permits efficient operation at headings very close to the wind, comprising a plurality of jib sails arranged so that the camber of the jibs is between 12 and 25%, preferably between 14% and 20%, most preferably between 14.5% and 18% when closehauled, and preferably the sheeting angle for the jibs is such that a continuation of the line of sheeting force intersects the luff of the jib at a point above about 65–80% of its length.

9 Claims, 4 Drawing Figures

SAIL RIGGING SYSTEM

BACKGROUND OF THE INVENTION

This invention is directed to improved systems for providing motive force for vessels using sails, and more particularly is directed to a sail system and method which permits development of substantial driving power at close angles to the wind.

Sails have been utilized to harness the power of the wind since ancient times. A prime desire has been to design systems that permit sailing at as small an angle to the wind as possible while still maintaining a sufficient forward force to drive the vessel in a forward direction. It has been difficult to design sailing rigs to accomplish that objective, partially because of the many factors which must be taken into account, including the necessary ability to handle large variations in wind velocity, the amount of heeling force which is generated by the rig, the necessity of providing a sail plan which can sail efficiently at other angles to the wind, the spatial constraints imposed by the necessity of fitting a rig to a vessel that can move through the water efficiently, and many other factors.

Most modern sailing craft, particularly the smaller pleasure craft, utilize a sloop rig comprising a jib, and a mainsail mounted on a main mast, possibly with one or more other masts bearing sails, usually farther aft of the main mast. Much of the review of the aerodynamics of sailing has been centered on the sloop rig, with emphasis on the interaction between the jib and the mainsail, and the way the jib affects the air flow over the mainsail. As used herein, the term "jib" refers to a triangular sail projecting forward of a mast, the leading edge (or luff) of which is not directly attached to the mast along its length, but is supported by a line or stay or similar thin support, which in turn is supported by the vessel and the mast, and typically runs between the deck and the mast. The jib, like all sails, acts not only as an object for the force of the wind to act upon, but also effects the direction of the wind which acts upon it. Most previous rigs have generally been designed with the idea of forming a perfect slot between the jib and the mainsail, so that the jib draws the air smoothly past the leeward side of the mainsail without backwinding the mainsail. In practice, even the most highly tuned jib and mainsail systems of racing yachts generally require a minimum angle of about 22°–25° from the apparent wind (usually about 40°–45° from the true wind), with forward force falling off drastically if closer angles to the apparent wind are attempted. This necessity of operating at large angles to the wind has a large number of disadvantages. The obvious one is the necessity of tacking at 40°–45° to the true wind, which means that even finely tuned sailboats can only make progress in the windward direction in 86°–90° increments. This disadvantage is increased in fore-and-aft rigged vessels, i.e., vessels having more than one mast, typically having a mizzen mast bearing one sail rigged on a boom behind that mast generally in the manner of a mainsail (e.g., a ketch or a yawl). Partially because of the effect of the forward sails on the wind before it reaches the aft sail(s), fore-and-aft rigged sailing craft are generally even less able to sail effectively at close angles to the wind than the simple sloop rig.

Another substantial disadvantage is the almost immediate loss of power and forward force which a standard sailboat experiences at angles closer into the wind than its optimum angle. As the angle into the wind decreases, the forward thrust drops, then the luff or forward edge of the sail begins to flap because of the air turbulence caused by the improper angle of the leading sail edge to the wind (often termed "luffing"), and then the sail loses its shape, flaps in the wind across its width, at which time it has lost its forward thrust entirely and the wind force on the flapping sail becomes almost purely a dragging force, tending to push the vessel backward, rather than forward. Because of the strong desire to point as closely into the wind as possible to reduce the distance the vessel must travel, sailors, particularly inexperienced ones, tend to sail at a closer angle into the wind than they should, somewhere between the optimum angle of the rig and the point where the sails are luffing. Since the sails appear full, and the apparent wind feels strong, the prime symptoms of sailing at such angles is the loss of power, which is difficult for the inexperienced to detect until it is too late, and headway is lost.

The inability to develop power at close angles to the wind is also one of the prime factors which has reduced the useability of sail power in commercial freight and passenger transportation. Faced with the prospect of having to veer forty-five or more degrees off course in order to obtain benefit from sail power, shippers do not make the capital investment to rig their vessels, but rather choose to expend the fuel costs and take the direct route under power.

Accordingly, it is an object of the present invention to provide a sail system which offers substantial forward thrust even at close angles to the wind.

It is another object of the invention to provide a sail system which has a wide tolerance of sailing efficiency, i.e., it produces substantial forward thrust without substantial adjustment over a wide range of angles to the wind.

It is a particular object of the present invention to provide a sail rigging system which permits fore-and-aft rigged vessels to sail efficiently at smaller angles into the wind.

It is a further object of the present invention to provide a sail rigging system which provides an improved ratio of driving force to heeling force over a wide range of angles to the wind.

It is a further object of the invention to provide a sail rigging system which is easily operated with minimum manpower over wide ranges of wind speed, particularly over the range of medium to heavy winds.

These and other objects and advantages which will be apparent to the skilled in the art from a consideration of this disclosure or practice of the invention disclosed herein are achieved by the invention described in greater detail below.

SUMMARY OF THE INVENTION

The present invention comprises a sail system containing a plurality of jibs mounted on a vessel, which jibs are attached to the vessel at an angle to their support stay such that the sheeting angle intersects the luff of the sail at a point above about 50–90% of its length, preferably above from about 65–80% of its length, and the jibs are maintained at high cambers. Preferably the cambers of the jibs, measured horizontally at the level of the clew, are between about 12 and 25%, preferably between about 14 and 20%, most preferably between 14.5 and 18%. Preferably, the vessel designed in accordance with the present invention has at least two jibs in fore-and aft relation, and the jibs are about the same size.

BRIEF DESCRIPTION OF THE DRAWINGS

This invention will be better understood in connection with the accompanying drawings in which.

DETAILED DESCRIPTION OF THE INVENTION

Figure 1:
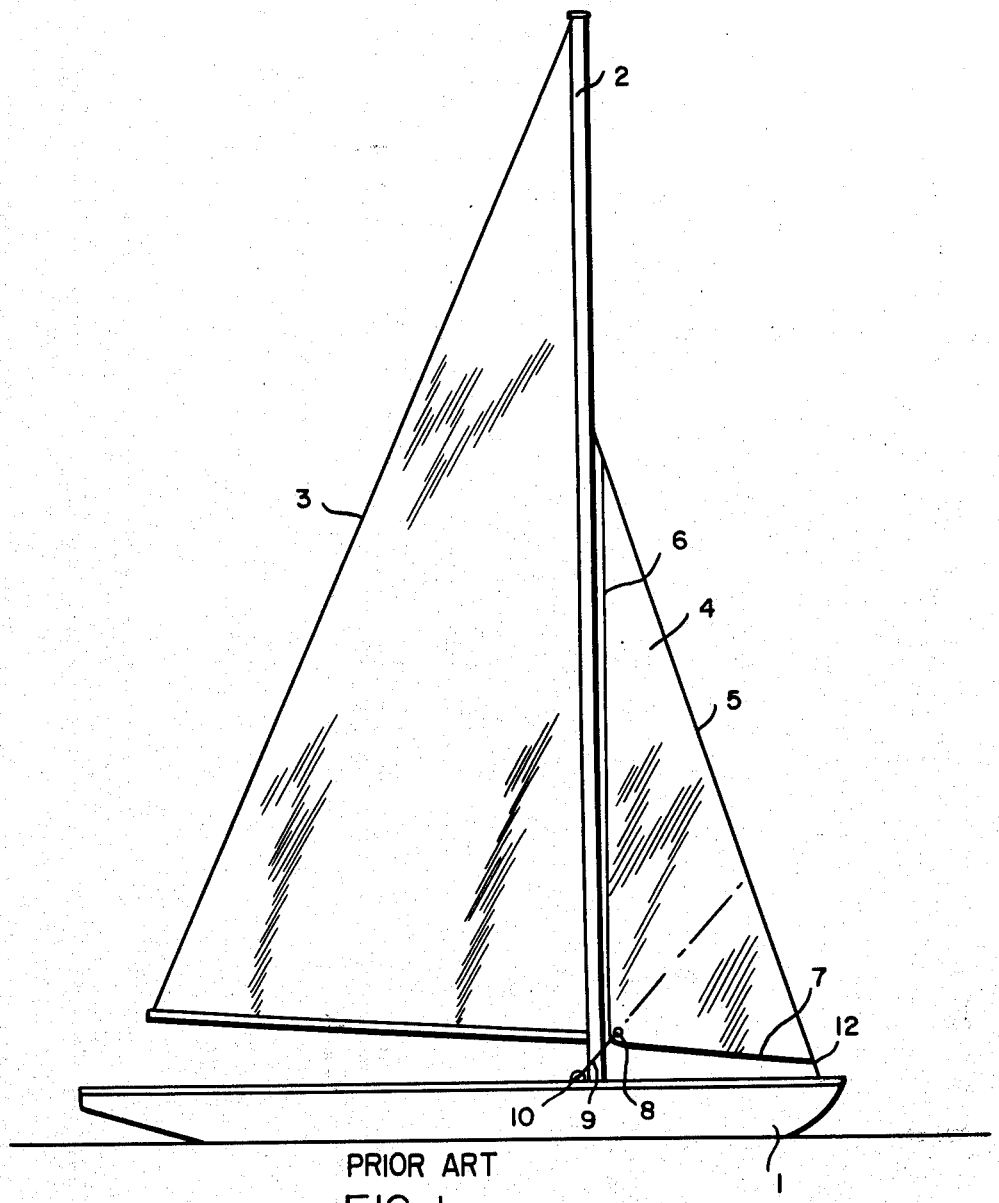
PRIOR ART FIG. 1
FIG. 1 is a side view of a typical sloop sail rig as used in the prior art.
Figure 2:
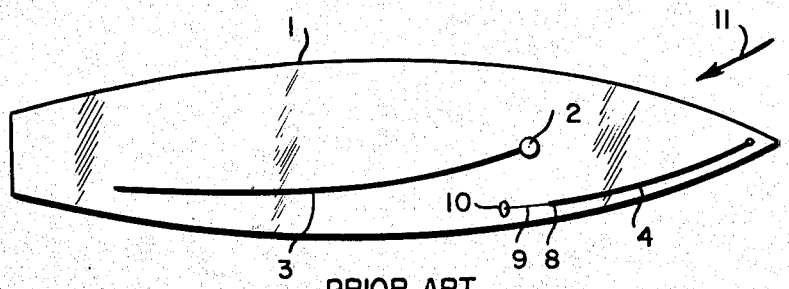
PRIOR ART FIG. 2
FIG. 2 is a top view of the sail rig depicted in FIG. 1.

FIGS. 1 and 2 depict a typical sloop rigged sailboat, having a hull 1, a mast 2, mainsail 3 and jib 4. Jib 4 has three edges, the luff 5, the leech 6, and the foot 7. Jib 4 is attached at its clew 8 to sheet 9 by suitable shackles or other means well known in the art. Sheet 9 passes through the fairlead 10 and thence usually to some means (not shown), such as a winch, for holding the sheet at any given extension, thus permitting adjustment of the position of the sail from the fixed point of the fairlead on the deck. Fairlead 10 may be any device such as a pulley which can be fixed to the deck and permit the sheet 9 to pass through. Many types of fairleads are well known in the art. Suitable means (not shown) are also provided for adjusting the mainsail 3. Again, suitable systems are well known; typically a multipart sheeting system and a traveler, which plays a role similar to the fairlead for the jib, are used.

FIG. 2 better illustrates the manner in which the sloop rig has typically been set for sailing at the smallest possible angle to the wind. The jib is typically adjusted to be quite flat or low in camber, e.g., 4–10%, and is fairly well spaced from the outer or leeward surface of the mainsail 4. The camber of a sail is a measure of the curvature of the sail and is generally expressed as the ratio of the depth of its curve, measured from an imaginary line drawn from the luff to the leech, divided by the length of that imaginary line. The direction of the apparent wind is indicated by arrow 11 in FIG. 2. As the wind flows past the surface of the sails its direction is changed, much as the direction of airflow is changed as it passes over an airplane wing. The force on the sail which moves a vessel is a combination of the pressure of the wind on the inner or windward surface of the sail and a vacuum created as the wind flows past the leeward surface of the sail. A primary reason that the jib is kept relatively flat and spaced substantially from the mainsail is to prevent the mainsail from being backwinded by the jib. This occurs when the wind leaving the leech of the jib is directed onto the front part of the leeward side of the main. Backwinding adversely affects the windflow at the front part of the mainsail and thus decreases substantially the forward thrust obtained from that sail.

A wide variety of studies of the aerodynamics of single sails and of standard sail plans and variations thereof have been published, reference to which will clarify any unfamiliar sailing terms. See, e.g., Marchaj, *Sailing Theory and Practice,* particularly Part II, Sections 1–14 (Dodd, Meak & Co., New York 1964), and J. H. Milgram, "Sail Force Coefficients for Systematic Rig Variations," *Society of Naval Architects and Marine Engineers Tech. & Res. Rept. R*-10 (1971), both of which are incorporated herein by reference.

The placement of the jib fairlead has a substantial effect on the sailing efficiency of the sloop rig, particularly at angles close to the wind. The difficulty has been in determining where the fairlead should be placed to obtain the proper sheeting angle for the sail. As used herein, the term "sheeting angle" is intended to mean the angle at which the sheeting force is applied to the clew of the sail, as measured against the lower part of the luff of the sail. For a simple one part sheeting system as shown in FIGS. 1 and 2, the sheeting angle would be the angle between the luff measured from the lower front corner 12 (i.e., the tack) of the jib, and a lead position line 9*a* extended upwards in the direction of the sheet 9 across the sail to the luff. A "lead position line" as used herein is an imagninary line extending from the direction of sheeting force, through the clew and across the sail to the luff. As pointed out by Marchaj at page 173, many have used the miter line of the clew, i.e., the line bisecting the angle of the clew, as a guide for fairlead placement. Some sailors place the fairlead along the miter line, some above it and some below it. Since the foot of a jib is normally shorter than the luff, the miter line will always intersect the luff at one of its lower points, e.g., at a point of from 25–35% of its length, as measured from tack 12. As also pointed out by Marchaj, the setting of the fairlead is a balance between avoiding too much twist in the sail along its leech and avoiding too much camber in the foot. If the fairlead is placed too far forward, tension on the sheet will put tension in the leech, preventing the upper portions of it from twisting to the leeward in response to wind pressure, but will also result in too much camber in the foot and a tendency of the leech to "curl over" to the windward, thus backwinding the main. On the other hand, placing the fairlead too far back will give the desired flatness in the foot of the sail, but will fail to maintain sufficient tension in the leech, which will permit the upper parts of the leech to twist to the leeward, and to flutter if the angle on the wind becomes too small. The method for setting the fairlead recommended by Marchaj and others is to set it at the point where the whole of the luff of the jib begins to flutter simultaneously as the boat is pointed towards the wind. The approach will normally set the sheeting angle somewhere near the miter line. Still others merely arrange the fairlead so that the sheeting angle is such that the imaginary line through the clew (9*a* in FIG. 1) intercepts the luff at about 40 to 75% of its length as measured from its tack, as a rough estimate of a manner of obtaining about the same results. See, e.g., Ross, "Sailpower" (Alfred A. Kopf, Inc., 1975 Ed.), also incorporated by reference, at 101–04.

While the sloop rigs have been considered to give the maximum capability of sailing into the wind at small angles, the angle to the wind at which such a rig can be sailed is severely limited as a practical matter, and the optimum setting for the sails at a particular angle to the wind is rather critical and unforgiving. That is to say that no matter how the sails in such a rig are set, the vessel cannot effectively sail closer than about 25°–30° to the apparent wind, since the forward thrust produced on such sails drops off very rapidly at angles closer than about 25°–30°. This problem is particulary acute in fore-and-aft rigged vessels. Moreover, once the sails are set for the closest angle into the wind, deviations in heading relative to the wind cause substantial forward thrust losses, not only for changes in a direction closer to the wind, but also changes in which the vessel is directed more away from the wind. Other problems with the sloop rig such as excessive healing force in relation to forward drive, difficulties in adjusting the rig to operate in different wind velocities, difficulties in rearranging to accommodate roller furling or reefing and self-tacking devices are well known, and many others well known in the art are described by Marchaj, supra.

Figure 3:
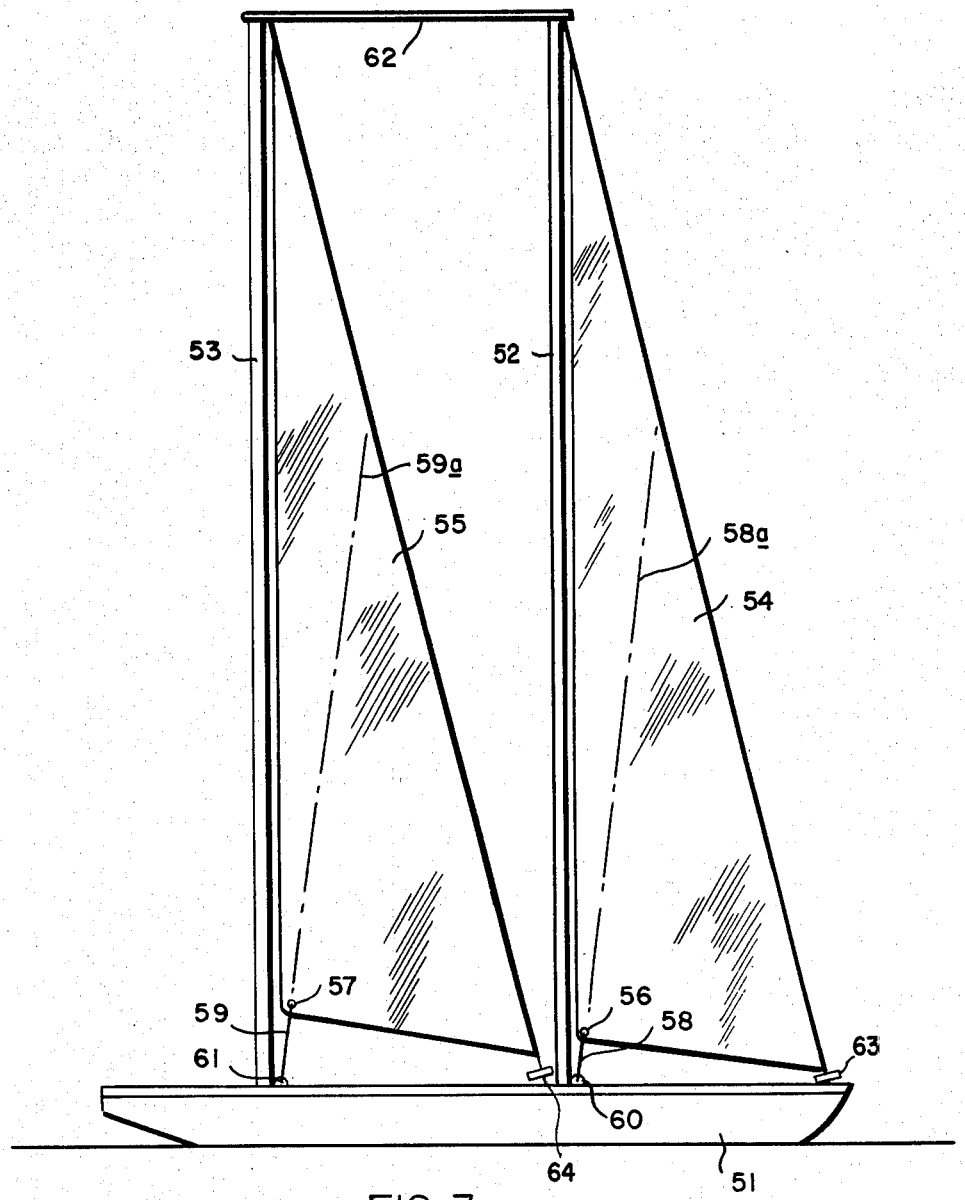
FIG. 3 is a side view of a preferred embodiment of the sail rig in accordance with the present invention.

It has now been found that it is possible to sail efficiently to windward at closer angles with less relative power loss for a given sail area than has been previously possible, and achieve many other significant advantages over previous sailing vessels, by utilizing the particular sailing rig of the present invention. As depicted in FIG. 3, the sailing vessel embodying the invention comprises a hull 51 with a plurality of masts 52 and 53, each bearing a jib numbered 54 and 55 respectively. Jib 54 is attached at its clew 56 to sheet 58, which then runs through its fairlead 60 to well known suitable means for adjusting and fixing the sheet (not shown). Similarly, jib 55 is attached at its clew 57 to sheet 59, which is run through its fairhead 61 to suitable adjustment means.

Figure 4:
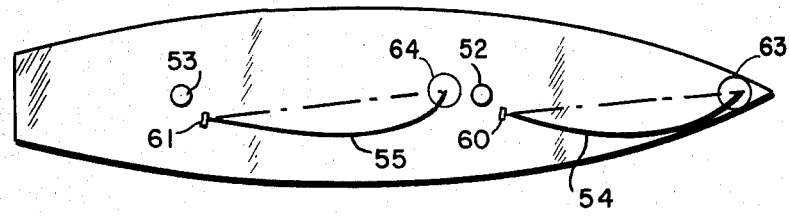
FIG. 4 is a top view of the sail plan of FIG. 3.

A striking difference can be observed in comparing the jib of FIG. 2 with the jibs of FIG. 4. Both jibs in FIG. 4 have a camber as measured horizontally at the clew of the jib of greater than 12%, e.g., a camber of between about 12% and 25%, preferably between about 14 and 20%, most preferably between 14.5 and 18%. As depicted in FIG. 4, both jibs have a camber of about 16%. Above this point the cambers generally increase within the above ranges to a maximum near the middle of the sail, and then decrease to essentially no camber at the very top of the sail.

As shown in FIGS. 3 and 4, the most preferred embodiment employs only sails which are not encumbered by a mast along their leading edge. However, if at least two sails are thus unencumbered, further sails akin to normal mains, i.e., attached to a mast along their luff, can also be employed. Preferably, the sheeting angle is set for both jibs so that the extension of the jib sheet intersects the luff at above more than 50% of its length, preferably from 60 to 90% of its height, more preferably from about 65–80% of its length.

The placement of the jib fairleads in relation to the centerline of the boat varies from that previously experienced with the sloop rig. As pointed out by Marchaj, supra, at 161–62, the fairlead setting in a normal sloop rig for "closehauled" sailing (e.g., sailing at an angle as close to the wind as practical), should be such that the "angle of trim" (the angle defined by a line from the clew of the jib to its tack on the one hand and by the centerline of the vessel on the other) is at least about 17°. The angle of trim is not nearly as crucial in the plural jib rig of the present invention, and can vary greatly depending on the size and shape of the sails and the characteristics of the vessel. With the rig of the present invention, the angle of trim can be from about 0° to 25° or more, preferably from about 8° to about 22°, most preferably from about 10° to 16°. The closer together the jibs are placed, the more likelihood that forward jib may have an adverse effect on the wind which drives the sail(s) further aft. In some instances, particularly in motor sailing, it may be preferable to use low angles of trim to get closer into the wind, even though there is some loss of sail efficiency because the overall efficiency of the vessel will still be greater, which will be reflected in reduced fuel consumption. At any rate, the optimum angle of trim will generally be less than those utilized on normal sloop rigs, at least partially because of the differences in the slot between the plural jibs of the present invention, and the slot between the jib and the main in the normal sloop rig.

An experienced sailor would be quite surprised that the jib settings shown in FIG. 4 represent the settings for sailing at a close angle into the wind. However, it has surprisingly been found that the sailing rig depicted in FIGS. 3 and 4 can not only be sailed at close angles into the wind, but can actually be sailed at closer angles to the wind with less relative power loss for a given sail area than sail rigs such as that depicted in FIGS. 1 and 2. The rig depicted in FIGS. 3 and 4 can be sailed as close to the apparent wind as 25° without apparent loss of power, and as close as 10° to the apparent wind under motor sailing without loss of the shape of the sails. This ability to hold its shape at extremely low angles is an additional benefit, since the luffing, which both increases the sail drag and has an adverse effect on the life of the sails, is not produced. At the same time, while the set of sails shown in FIGS. 3 and 4 is for sailing at close angles to the wind, the same sail setting is useful without substantial loss of power at larger angles to the wind, again without as substantial a relative power loss for a given sail area as if a sail plan such as depicted in FIGS. 1 and 2 were at angles to the wind greater than the optimum angles for that setting of those sails.

These same advantages were not achieved by previous multiple-jib craft, such as the 128 foot, triple jib Vrendredi 13, designed by the present inventor for the single-handed Atlantic crossing race which it participated in in 1972. See *Life*, Vol. 68, pp. 86–92, (1972), also hereby incorporated by reference. That vessel had three large jibs in fore-and-aft relationship, but rigged and sheeted in a similar manner to the standard methods of handling jibs on sloop rigs. Those jibs were flat in camber, and were sheeted in a much different way than those of the present invention. Those jibs were not merely sheeted at the clew, but rather were attached to a straight boom at various points all along the foot, and the foot of each sail was rendered taut along that boom by an outhaul attached to the clew. As a result, the foot of each of those sails was of extremely low camber.

Preferably the masts and the jibs are of approximately the same size, but either of the masts can be larger than the other. The jibs also can be different in size and/or shape, whether or not the masts are the same size. The two masts can be attached to each other by a compression member 62, which obviates the need for a backstay, thus allowing the rear mast to be placed closer to the transom of the vessel.

The rig of the present invention is particularly advantageous in medium to strong winds, and preferably at least one and more preferably all of the jibs are equipped with roller furling apparatus, which itself is well known and readily available in the art, and which is shown systematically at 63 and 64 on FIGS. 3 and 4. The use of roller furling in combination with the rig of the present invention magnifies the basic stability of the present system to such an extent that almost any wind situation can be handled comfortably with a minimum of effort. If heavy weather comes up, the aft jib can be partially furled to the point where the vessel handles the wind comfortably. If the strength of the wind increases even more, the aft jib can be furled even more and forward jib(s) can be furled, so that the vessel can remain comfortably under sail in a wide variety of strong winds. Anyone who has had to attempt to reef the main and furl the jib in a sudden heavy blow in a standard sloop rig will appreciate the substantial advantage of this ability of the present invention to simply and smoothly adjust for any conditions. The sheeting angles of the present invention are such that as the sails are furled, not only is the heeling moment decreased by the reduction in sail area, but the sails as they are furled become flatter as the effective sheeting angle decreases, and this loss of camber also decreases the heeling moment substantially. This effect of furling in the rig of the present invention is approximately equivalent to taking the sails down and changing to a smaller, flatter set of sails in the normal sloop rig.

It is also preferred that the sails in the present invention be furnished with apparatus making the sails self-tacking. A wide variety of self-tacking systems are well known and readily commercially available. For example, the fairleads for the sails can be attached to a moveable shuttle which is mounted for transverse movement (i.e., on wheels) between the proper fairlead positions when the wind is on one or the other side of the vessel.

Particular advantage can be taken of the sailing rig of the present invention in connection with motor sailing. Sailing vessels operating into the wind under engine power have been faced with the decision of either altering course sufficiently so that the sails are at a wide enough angle to the wind to provide some assistance to the engine, or simply taking all sails down and operating under power alone.

However, the peculiar ability of the present sailing rig to provide substantial power at even very close angles into the wind, together with the extreme simplicity and ease of handling the sails in all types of weather makes fuel savings by the use of sail power practical, particularly for commercial vessels. Commercial vessels faced with deadlines have difficulty in justifying on the basis of fuel savings the longer distances and increased shipping times involved in tacking at large angles to the prevailing westerlies in transatlantic or transpacific crossing, for example. Particularly when the sails are equipped with roller furling and self-tacking mechanisms, as preferred, the sails are essentially self-tending, and provide substantial additional power at most of the possible angles to the wind. Of course, the sheets can be utilized to vary the sail positions from those shown in FIGS. 3 and 4 for increasing the efficiency somewhat at larger angles to the wind. However, because of the ability of the present sailing rig to provide almost full power over a wide range of sailing angles from the optimum sailing angle, the handling of the sails is at an absolute minimum. Thus the training and manpower in using the present systems are similarly minimized.

While the arrangement and advantages of the disclosed embodiments have been described with particularity, other embodiments will be readily apparent to the skilled in the art from a consideration of the present disclosure or from practicing the invention disclosed herein. The embodiments discussed in this specification are to be considered as exemplarly only, and the true scope of the invention should be determined by a consideration of the appended claims.

I claim:

1. A sail system, comprising a vessel having a plurality of masts and jibs, means for attaching each jib to each mast and supporting at least an upper part of said jib, means associated with each mast for attaching the tack of a jib to the vessel as a point directly forward of the mast, and fairlead means associated with each mast for attaching the clew of a jib to the vessel at a point such that, when the upper part is supported by the mast and the tack is attached to the vessel, at least one of said jibs, when closehauled, has a camber of about 12% to 25%, as measured horizontally at the clew of that jib and the angle of trim between the clew of that jib, the tack of that jib and the centerline of the vessel is from about 10% to 16%, and wherein the lead position line defined by the fairlead means and the clew intersects the luff of the jib at a point between about 65 and 80% of the length of the luff, measured from the tack, and wherein at least one of said jibs is attached to roller furling means for reducing the exposed area of that jib.

2. The system of claim 1, wherein each of said jibs have a camber of from about 12% to 25% when closehauled.

3. The system of claim 2, wherein each of said jibs have a camber of about 14% to 20% when closehauled.

4. The system of claim 3, comprising two masts and two jibs.

5. The system of claim 4, wherein the two masts are both about the same length.

6. The system of claim 4, wherein one of the masts is directly behind the other.

7. The system of claim 1, wherein at least two of the masts are attached at an upper point by a rigid compression support means.

8. The system of claim 1, wherein at least one of said jibs has a camber of between 14.5% and 18% when closehauled.

9. The system of claim 1 wherein each of said jibs is attached to roller furling means for reducing the exposed area of the jib.

* * * * *